United States Patent [19]

Mochizuki et al.

[11] Patent Number: 4,475,021

[45] Date of Patent: Oct. 2, 1984

[54] AIR CIRCUIT BREAKER

[75] Inventors: Yoshinori Mochizuki; Kiyoshi Eguchi; Takayoshi Ishikawa; Yasushi Genba; Shigemi Tamaru; Masayuki Okada, all of Fukuyama, Japan

[73] Assignee: Mitsubishi Denki Kabushiki Kaisha, Tokyo, Japan

[21] Appl. No.: 460,795

[22] Filed: Jan. 25, 1983

[30] Foreign Application Priority Data

Jan. 29, 1982 [JP] Japan ..... 57-12869[U]

[51] Int. Cl.[3] ..... H01H 3/00

[52] U.S. Cl. ..... 200/153 SC; 200/153 G; 200/323

[58] Field of Search ..... 200/153 SC, 153 G, 156 H, 200/288, 318, 321, 322, 323, 324, 325

[56] References Cited

U.S. PATENT DOCUMENTS

| | | | |
|---|---|---|---|
| 3,585,330 | 6/1971 | Bould . | |
| 3,600,540 | 8/1971 | Bould | 200/153 SC |
| 3,729,065 | 4/1973 | Baskerville et al. | 200/153 SC X |
| 3,832,504 | 8/1974 | Cellerini et al. | 200/153 SC |
| 4,019,008 | 4/1977 | Kohler et al. | 200/153 SC |
| 4,137,436 | 1/1979 | Bar Kan et al. | 200/153 SC |
| 4,167,988 | 9/1979 | Acampora et al. | 200/153 SC X |
| 4,409,449 | 10/1983 | Takano et al. | 200/153 SC |

*Primary Examiner*—Stephen Marcus
*Assistant Examiner*—Ernest G. Cusick
*Attorney, Agent, or Firm*—Oblon, Fisher, Spivak, McClelland & Maier

[57] ABSTRACT

The present invention describes an air circuit breaker including, in combination, a rotational shaft connected with a motor, a cam which rotates in one direction through a ratchet by a handle operation to accumulate energy in an energy accumulating spring for contact closure, an engaging part provided on the outer periphery of the rotational shaft, and a latch which slides on and along the engaging part of the rotational shaft such that the latch means remains disengaged from the engaging part when the cam is rotated by the handle operation so that the rotational shaft remains stationary, and which causes the cam to rotate together with the rotational shaft by engaging the engaging part of the rotational shaft when the rotational shaft is rotated in one and the same direction by the driving motor.

7 Claims, 12 Drawing Figures

AIR CIRCUIT BREAKER

BACKGROUND OF THE INVENTION

1. Field of the Invention

This invention relates to an air circuit breaker, and more particularly, it is concerned with an air circuit breaker of a type, in which an electric conduction section thereof is closed by an accumulated force from an energy accumulating spring, upon instructions being given to the breaker, after accumulation of energy in the energy accumulating spring.

2. Description of the Prior Art

Heretofore, the energy accumulation in an energy accumulating spring for this type of the circuit breaker has been done, for example, by a handle operation, on account of which no energy accumulation by a remote control operation could be effected thereby causing inconveniences from time to time.

SUMMARY OF THE INVENTION

The present invention has been made with a view to eliminating the abovementioned shortcoming inherent in the conventional air circuit breaker, and aims at providing an improved air circuit breaker which is simple in construction and is able to perform conveniently the energy accumulation in the energy accumulating spring by both manual and electrical means.

According to the present invention, in general aspect thereof, there is provided an air circuit breaker which comprises, in combination, a rotational shaft connected with a motor, a cam which rotates in one direction through a ratchet by a handle operation to accumulate energy in an energy accumulating spring for contact closure, an engaging part provided on the outer periphery of said rotational shaft, and a latch which slides on and along the engaging part of said rotational shaft when said cam is rotated by said handle operation, and which causes said cam to rotate together with said rotational shaft in engagement with said engaging part of said rotational shaft when said rotational shaft is rotated in one and same direction by said motor.

The foregoing object, and various other objects as well as features and attendant advantages of the specific construction and operations of the air circuit breaker according to the present invention will become more apparent and understandable from the following detailed description thereof when read in conjunction with the accompanying drawing in which like reference characters designate like or corresponding parts throughout the several views and wherein:

DETAILED DESCRIPTION OF THE PREFERRED EMBODIMENT

In the following, the present invention will be explained in specific details with reference to a preferred embodiment of the air circuit breaker according to the present invention as shown in the accompanying drawings.

Figure 1:
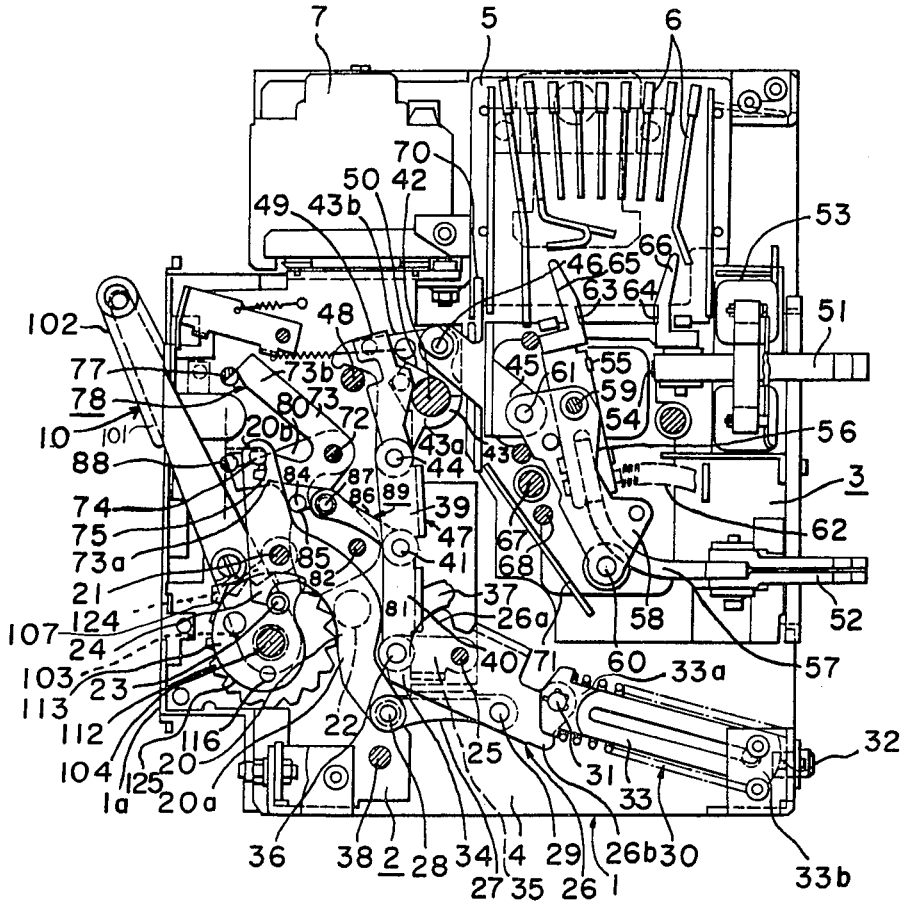
FIG. 1 is a cross-sectional side elevational view showing one embodiment of the air circuit breaker according to the present invention.

Referring first to FIG. 1 showing a cross-sectional side elevational view of one embodiment of the air circuit breaker according to the present invention, a reference numeral (1) designates a housing, a numeral (2) refers to a unit casing for an energy accumulating section, and a numeral (3) denotes a unit casing for an electric conduction section. The unit casing (2) for the energy accumulating section is positioned at the front side (left side as viewed from the top surface of the drawing sheet) of the housing (1), while the unit casing (3) for the electric conduction section is positioned at the rear side thereof (right side as viewed from the top surface of the drawing sheet). Both unit casings are fixedly secured to a side plate (4) constituting a part of the housing (1). A reference numeral (5) designates an arc extinguishing chamber having a plurality of arc extinguishing plates (6) and being engaged with the abovementioned unit casing (3) for the electric conduction section, and a numeral (7) refers to a casing for an electrical control section such as a trip relay, and other types of electrical elements.

In the following, construction of each component section in the circuit breaker will be explained in details.

Figure 2:
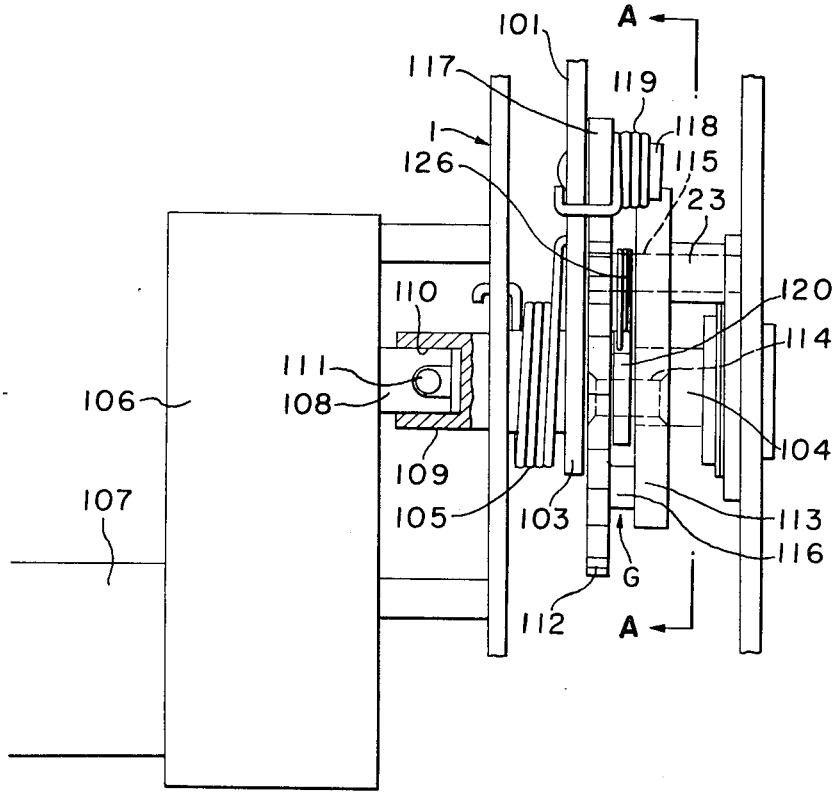
FIG. 2 is an explantory diagram of an energy accumulating and force transmitting mechanism.
Figure 3:
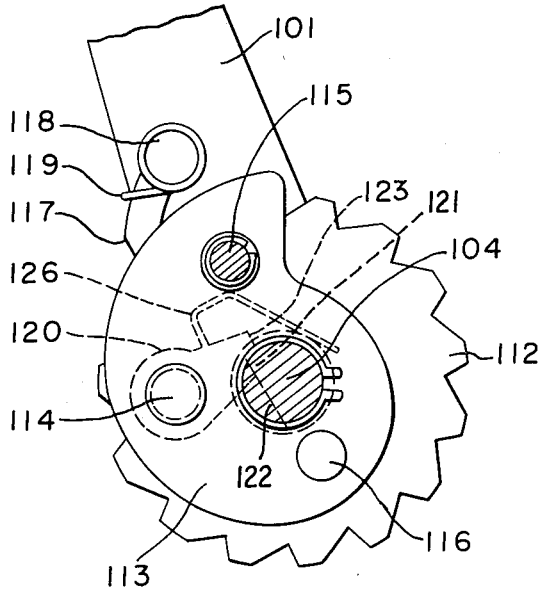
FIG. 3 is a cross-sectional view taken along a line A—A in FIG. 2.

A reference numeral (10) designates a force transmitting mechanism for energy accumulation, which has an operating handle (101) disposed in the housing (1) in a posture of a frontward inclination. An operating end (102) of this handle (101) projects outward at the upper portion of a front wall **(1*a*) of the housing (1), while a base end (103) thereof is rotatably mounted on a rotational shaft (104) disposed in the vicinity of the lower part of the front wall (1*a*) of the housing (1). As shown in FIG. 2, a handle returning spring (105) is extended between the base end (103) of the abovementioned handle (101) and the housing (1), and a motor (107) is provided in the housing (1) through a gear box (106). A final output shaft (108) of this gear box (106) transmits a rotational force of the motor (107), and the output shaft (108) is fit into a shaft hole (110) formed at one end part (109) of the rotational shaft (104) so as to be rotatably coupled with the shaft (104) by means of a torque pin (111). In addition, a ratchet (112) and a cam (113) are supported on this rotational shaft (104) in a freely rotatable manner. The ratchet (112) and the cam (113) are integrally coupled by means of three connecting pins (114), (115) and (116) as shown in FIG. 3, thereby keeping a gap G between ratchet (112) and cam (113) (see FIG. 2). In FIGS. 2 and 3, a reference numeral (117) denotes a movable pawl which is provided on the abovementioned operating handle (101)** by a supporting pin (118) in a freely rotatable manner, and is urged against ratchet (112) by a spring (119). This pawl (117) intermittently drives the ratchet (112) counterclockwise by the lowering operation of the handle (101).

In FIG. 3, a reference numeral (120) designates a latch rotatably supported on the abovementioned connecting pin (114). A distal end part (121) of this latch (120) is urged to the outer periphery of the rotational shaft (104) by means of a spring (126) extended between the latch (120) and the outer periphery of the rotational shaft (104). On the outer periphery of the rotational shaft (104), there is notch-formed an engaging part (122) to be engaged with the distal end part (121) of the abovementioned latch (120) at the time of the counterclockwise rotation of the rotational shaft (see FIG. 4). A reference numeral (123) refers to a projection provided at the distal end (121) of the abovementioned latch (120). The projection (123) is engaged with the outer periphery of the rotational shaft (104) when the abovementioned distal end part (121) engages the abovementioned engaging part (122) to secure the engaged state of the distal end part (121) to the engaging part (122). Incidentally, a reference numeral (124) in FIG. 1 designates a locking pawl, which is pivotally mounted on the pivotal shaft of the charge lever to be mentioned later, to hinder the returning rotation of the abovementioned ratchet (112).

In FIG. 1, a numeral (20) refers to a charge lever which extends upward from the back side of the cam (113), and is pivotally supported in a rotatable manner on a shaft (21) above the cam (113). A roller (22), which roll-contacts the cam (113) at the time of the handle (101) operation, is mounted on a lower end part (20*a*) of the charge lever (20). Further, an obstructing piece (24), which is applied against a roller (23) provided on the connecting pin (115) of the cam (113) at the completion of the energy accumulation is projectively provided in integration with the charge lever (20). A closed arm (26), having an upper end part (26*a*) which is pivotally supported in a rotatable manner on a pivotal shaft (25), is disposed rearwardly of the lower end part (20*a*) of the charge lever (20). The closed arm (26) is connected to the lower end part (20*a*) of the abovementioned charge lever (20) through a link (27). Reference numerals (28), (29) designate connecting pins connecting end part (20*a*) and closed arm (26) respectively, to the abovementioned link (27). A numeral (30) refers to an energy accumulating spring disposed at the lower end side of the rear part (right side in the drawing) of the housing (1), for which a compression coil spring is used. This spring (30) is mounted on an extendible spring holder (33), the spring holder (33) having one end (33*a*) and an other end (33*b*) which are pivotally and rotatably fitted on a lower end side (26*b*) of the closed arm (26) and the housing side (1) respectively, by pins (31) and (32), respectively. The spring holder (33) effects smooth compression deformation of the spring (30).

On the pivotal shaft (25) of the abovementioned closed arm (26), there is pivotally and rotatably supported a link (35) which is pushed up by a push-up piece (34) on the upper side end part (26*a*) of the closed arm (26) at the time of energizing spring force in the abovementioned spring (30), and link (35) displaces in an arcuate manner. A reference numeral (36) designates a pin which is provided at the displaced end of the link (35) and pushed by the push-up piece (34); a numeral (37) refers to an arcuate guide hole formed in the abovementioned casing (2), into which the abovementioned pin (36) is fitted; and a numeral (38) denotes an obstructing pin against clockwise rotation of the closed arm (26). Numerals (39) and (40) refer to a pair of links which are disposed in the vertical direction on the upper side of the closed arm (26), and link (39) is connected to link 40 through a pin (41) in a bendable manner. The lower side of the link (40) is connected with link (35) by means of the abovementioned pin (36). A numeral (42) refers to a pivotal shaft which is fixedly positioned above links (39) and (40), i.e., in front of (left side in the drawing) the abovementioned casing (3) for the electric conduction section, and a numeral (43) denotes a direction changing lever which is pivotally and rotatably held on the shaft (42). To a lower end part (43*a*) of this lever (43), there is connected the upper end part of the link (39) on the upper side of the abovementioned pair of links (39) and (40) through a connecting pin (44). The upper end part (43*b*) of the lever (43) has a pin (46), to which one end of an insulating link (45), which is a part of a contact opening and closing mechanism (69) at the side of the electric conduction section, to be explained later, is connected. A link mechanism (47) for transmitting accumulated energy force is defined by the abovementioned pair of links (39), (40) and associated elements. A reference numeral (48) designates an obstructing shaft against the counterclockwise rotation of the lever (43); a numeral (49) refers to a preventive member which prevents the lever (43) from spring-back motion; and a numeral (50) indicates a return spring for this preventive member (49).

Numerals (51) and (52) refer to a pair of conductors which are a part of the electric conduction section; a reference numeral (53) designates a current transformer provided in one of the conductors (51); and a numeral (54) denotes a main fixed contact point fixedly secured at the tip end of this conductor (51). A reference numeral (56) represents a movable piece, on which a movable contact (55) is fixedly secured. A base end part of this movable piece (56) and the other conductor (52) are electrically connected by means of a flexible conductor (57). A numeral (58) denotes a movable piece holder which holds the movable piece (56) by means of a pivot pin (59). The lower end part of this holder (58) is pivotally and rotatably supported on the casing (3) through a pivotal shaft (60), while the upper end part of holder (58) is connected to other end of the abovementioned insulating link (45) through a pin (61). A numeral (62) refers to a contact-pressing spring which extends between the abovementioned movable piece (56) and the casing side (3) to impart to this movable piece (56) a spring force in the direction of the contact to closure between fixed contact (54) and movable contact (55); numerals (63) and (64) refer respectively to a movable arc contact and a fixed arc contact; numerals (65) and (66) denote respectively holding members for the arc contacts (63) and (64); and a numeral (67) refers to a stopper for restricting rotation of the movable piece holder (58). A contact opening and closing mechanism (69) is defined by the abovementioned movable piece (56), movable piece holder (58), insulating link (45), and associated elements (see FIGS. 8 and 9). Reference numerals (70) and (71) designate partition walls.

Figure 5:
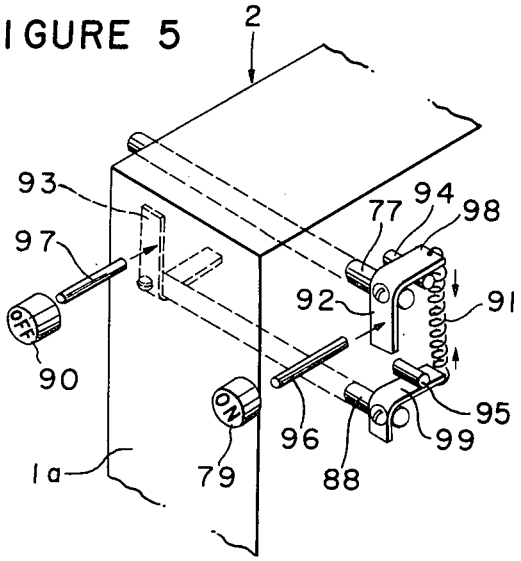
FIG. 5 is a schematic structural diagram of an ON-OFF operating section in the air circuit breaker according to the present invention.

At a position above the charge lever (20), there is rotatably disposed, on a pivotal shaft (72), a closure latch (73) in a substantial form of a letter "J" or a fishhook. At the distal end of the lower end part (73*a*) of this latch (73), there is formed a notched portion (75) to receive therein an urging force in the clockwise direction from an engaging and stopping roller (74) fixed at the upper end part (20*b*) of the charge lever (20). The notched portion (75) is so set that, at the completion of the pressure accumulation, the abovementioned urging force may be against the clockwise spring force of a return spring (76) (see FIG. 6). A reference numeral (77) designates a latch having a D-shaped cross-section which engages an upper end (73*b*) of the abovementioned closure latch (73) in an engageable and disengageable manner to hinder the counterclockwise rotation thereof. The latch (77) is rotatably mounted on the casing (2), and defines a standby maintaining mechanism (78) for contact closure together with the abovementioned closure latch (73), and associated elements. As shown in FIG. 5, the D-shaped latch (77) is so adapted that it may rotate counterclockwise by an ON-operation member (79) which releases the abovementioned closure standby state.

Figure 6:
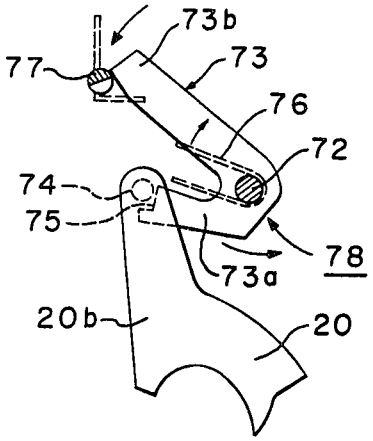
FIG. 6 is an explanatory diagram of a energy maintaining mechanism for contact closure.
Figure 7:
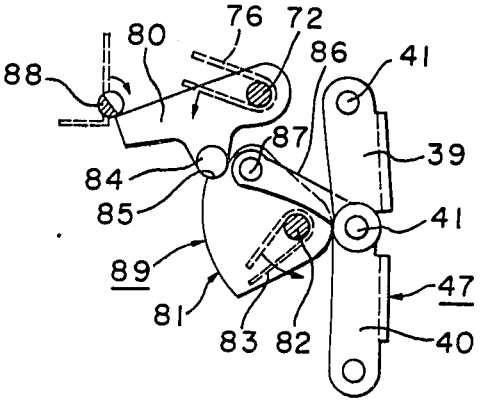
FIG. 7 is an explanatory diagram of a mechanism for maintaining contact opening.

A numeral (80) refers to a trip latch which is rotatably pivoted on the pivotal shaft (72) of the closure latch (73) and is subjected to a counterclockwise spring force from the abovementioned return spring (76) (see FIG. 6). A numeral (81) refers to a cam plate which is rotatably pivoted on a shaft (82) below the trip latch (80), and to which a counterclockwise spring force of a return spring (83) is imparted, as shown in FIG. 7. The cam plate (81) is so constructed that it has a recessed portion (85) adapted to be engaged with and disengaged from an engaging and stopping roller (84) affixed at the lower end projected part of the trip latch (80), and recessed portion (85) imparts to the trip latch (80) clockwise urging force against force of the return spring (83). A reference numeral (86) in FIG. 1 designates a cross-bridging link connected by a pin (87) of the cam plate (81) and the connecting pin (41) to the abovementioned pair of links (39) and (40). A numeral (88) refers to a latch having a D-shaped cross-section to inhibit the clockwise rotation of the abovementioned trip latch (80). The latch (88) is rotatably mounted on the casing (2), and functions as a standby maintaining mechanism (89) for contact opening, which causes the abovementioned link mechanism (47) to stretch against the spring force of the abovementioned contact-pressing spring (62). The D-shaped latch (88) is so formed that it is rotated in the clockwise direction by the OFF-operation member (90) shown in FIG. 5. Incidentally, in FIG. 5, a reference numeral (91) designates an automatic return spring for the D-shaped latches (77) and (88); numerals (92) and (93), respectively refer to members provided on the D-shaped latches (77) and (88) to be subjected to operation; (94) and (95) denote stoppers; (98) and (99) denote stopper arms operatively associated with stoppers (94), (95), and latches (77), (88), respectively; and (96) and (97) represent push-in rods which operate members (92), (93), respectively, to rotate D-shaped latches (77), (88), respectively.

In the following, actual operation of the abovementioned invention will be explained.

(I) At the time of energy accumulation in the energy accumulating spring:

First of all, when the handle (101) in FIG. 1 is subjected to push-down operation against force of the handle return spring (105), the movable pawl (117) rotates the ratchet (112) in the counterclockwise direction about rotational shaft (104), and the cam (113) is thereby rotated in the same direction about rotational shaft (104); accordingly the charge lever (20) is rotated counterclockwise with its shaft (21) as the center of rotation through the roller (22) which is roll-contacted to the cam surface (125) (see FIG. 10A). By this rotational displacement of the charge lever (20) in the counterclockwise direction, the closed arm (26) rotationally displaces in the counterclockwise direction around the shaft (25) by means of the link (27), whereby compression of the energy accumulating spring (30) starts. The compressive deformation of the energy accumulating spring (30) further proceeds by repetition of the abovementioned handle operations.

Figure 4:
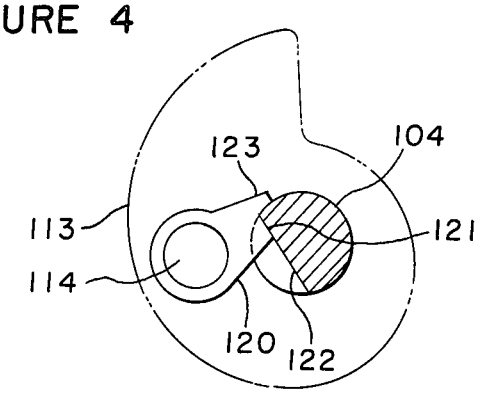
FIG. 4 is a diagram showing a state of engagement between a latch and a rotational shaft in the energy accumulating and force transmitting mechanism shown in FIG. 2.

During the abovementioned handle operation, the distal end part (121) of the latch (120), as shown in FIG. 4, rotates in a counterclockwise direction about rotational shaft (104) without engaging the engaging part (122) of the rotational shaft (104) against the force of the spring (126) due to the rotation of the cam (113) such that the rotational shaft (104) remains stationary during the handle operation (see FIG. 3).

On the other hand, when the compressive deformation of the abovementioned energy accumulating spring (30) is done by the motor (107) (see FIG. 2), the motor (107) rotates the rotational shaft (104) in the counterclockwise direction, whereby the engaging part (122) of the rotational shaft (104) (see FIG. 4) is engaged with the distal end part (121) of the latch (120), the cam (113) rotates in the counterclockwise direction, and the compressive deformation of the energy accumulating spring (30) is effected in the same manner as mentioned above.

Incidentally, the pin (114), on which the latch (120) is mounted, is affixed at its ends to the ratchet (112) and the cam (113), respectively, as shown in FIG. 2, whereby the latch (120) is able to receive the rotational force of the rotational shaft (104) with good stability from the standpoint of its mechanical strength. Further, as shown in FIG. 4, when the distal end part (121) of the latch (120) falls onto the engaging part (122) of the rotational shaft (104), the engaged state of the distal end part (121) with respect to the engaging part (122) is secured by the projection (123), so that, at the time of the energy accumulation caused by the motor (107) (see FIG. 2), the abovementioned engaging part (122) is exactly engaged with the abovementioned latch (120) to obtain smooth energy accumulating operation.

Figure 10:
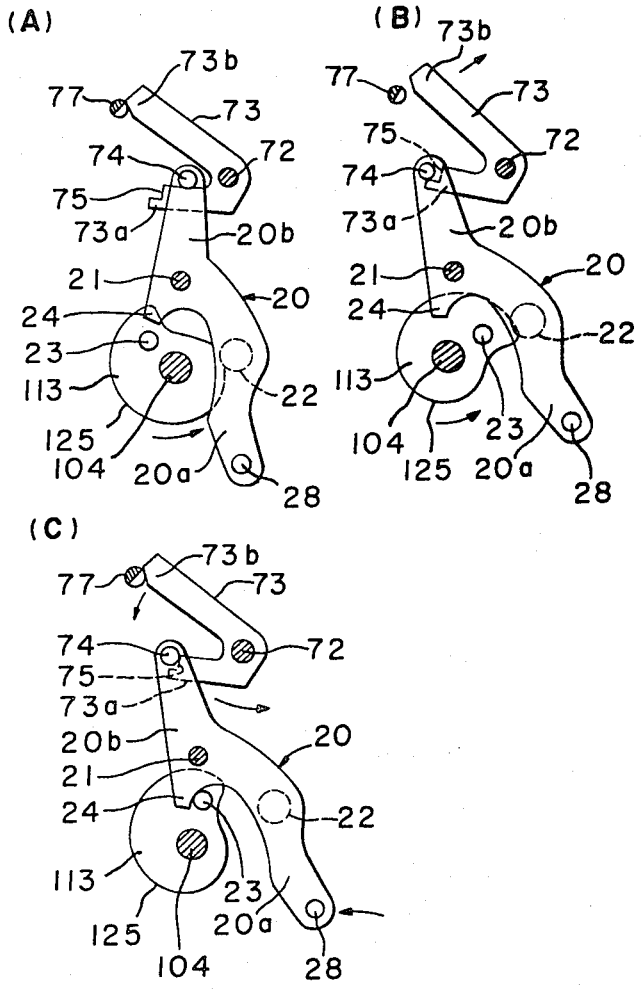
FIGS. 10A, 10B and 10C are respectively explanatory diagrams for the operations of the charge lever.

By carrying out the push-down operation of the abovementioned handle (101) for a predetermined number of times, e.g., several times, or by the operation of the motor (107) for a predetermined number of revolutions in place of the manual push-down operation, the cam (113) is slightly rotated in the counterclockwise direction such that the charge lever (20) is displaced its maximum amount (see FIG. 10 (B)), while, at the same time, the roller (23) collides with the obstructing piece (24) on the charge lever (20) (see FIG. 10 (C)), whereby rotation of the cam (113) is hindered and the energy accumulating operation of the energy accumulating spring (30) is completed (see FIG. 1).

At the completion of the abovementioned energy accumulating operation, the stretched spring force of the energy accumulating spring (30) tends to rotate the abovementioned charge lever (20) about its shaft (21) in the clockwise direction by means of the closed arm (26) and the link (27). On account of this, the engaging and stopping roller (74) at the upper end part (20*b*) of the charge lever (20) urges the notched part (75) at the lower end portion (73*a*) of the closure latch (73) to cause the latch (73) to rotate counterclockwise against force of the return spring (76). However, on account of the abovementioned counterclockwise rotation of the closure latch (73), the upper end (73*b*) of the latch (73) is engaged with the D-shaped latch (77), and the counterclockwise rotation of the closure latch (73) is stopped, in other words, the clockwise rotation of the charge lever (20) is hindered (see FIGS. 6 and 10(C)). Accordingly, the push-up force of the closed arm (26) transmitted to the pin (36) in the link mechanism (47) is also hindered, and the closure of the removable contact (55) to the fixed contact (54) through the abovementioned link mechanism (47), is set in a standby state.

Figure 8:
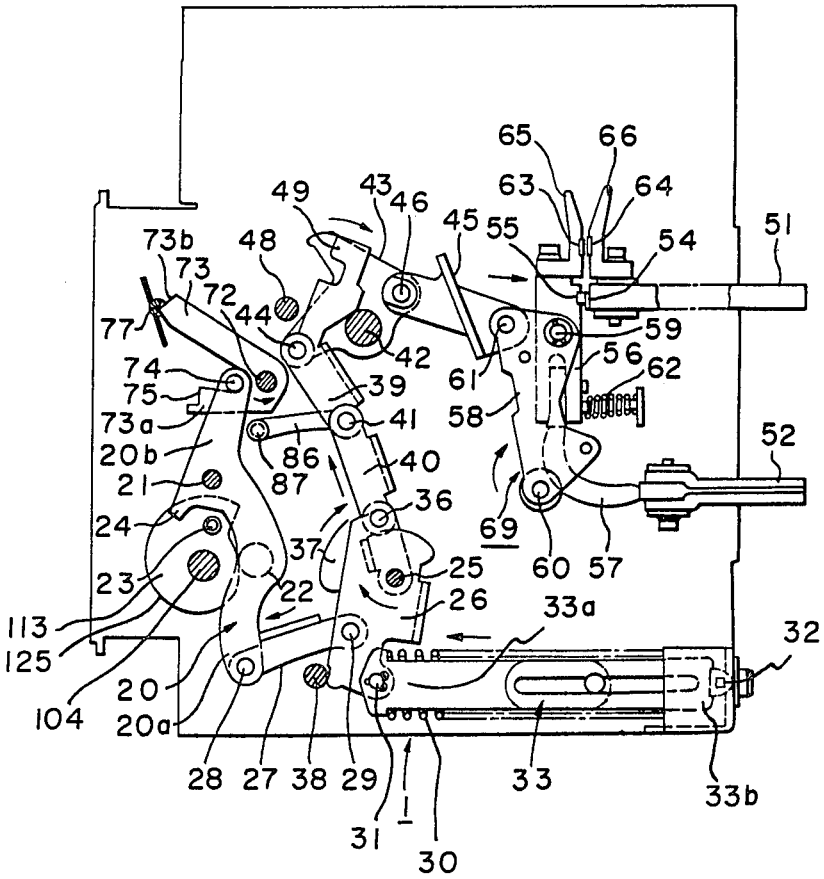
FIG. 8 is a diagram showing an operational state of the breaker at the time of the ON-operation.

(II) At the time of ON-operation:

At first, when the ON-operation member (79) shown in FIG. 5 is operated against force of the automatic return spring (91) to rotate the D-shaped latch (77) in the counterclockwise direction, the closure latch (73) rotates counterclockwise from its state as shown in FIG. 10(C). On account of this, the engaging and stopping roller (74) at the upper end part (20*b*) of the charge lever (20) is released from the notched part (75) of the closure latch (73), and the charge lever (20) is subjected to the force of the energy accumulating spring (30) so as to be rotated in the clockwise direction, as shown in FIG. 8. In consequence of this, the closed arm (26) is also rotated about the shaft (25) in the clockwise direction by means of the link (27). By the rotation of the abovementioned closed arm (26) under force of the energy accumulating spring (30), the push-up piece (34) of this closed arm (26) pushes the pin (36) upward and along the arcuate guide hole (37), hence the pair of links (39) and (40) are also displaced upward and driven into their stretched state.

By the upward displacement of the links (39) and (40), the direction changing lever (43) rotates clockwise. The rotational force of this lever (43) is transmitted to the contact point opening and closing mechanism (69) through the insulating link (45). In more detail, since the movable piece holder (58) holding the movable piece (56) is rotated clockwise with its shaft (60) as the center of rotation, the movable contact (55) comes into electrical contact with the fixed contact point (54) against the force of the contact-pressing spring (62) to bring about the contact point closure state. In this state, the energy accumulating spring (30) is de-energized, while the counter-pressing spring (62) is compressed for energy accumulation.

In the state as mentioned above, where the energy accumulating spring (30) is de-energized and the contact points (54) and (55) are in electrical contact, the accumulated spring force of the counter-pressing spring (62) is apt to rotate the direction changing lever (43) about the shaft (42) in the counterclockwise direction by means of the movable piece (56), holder (58), and insulating link (45).

Incidentally, since the abovementioned direction changing lever (43) is subjected to the rotational force in the counterclockwise direction, the pair of links (39) and (40) connected to this lever (43) are subjected to a rightward urging force, by which urging force the cam plate (81) is subjected to a clockwise rotational force about the shaft (82) by means of the cross-bridging link (86) as shown in FIG. 7. On account of this, the cam plate (81) pushes up the trip latch (80) against the force of the return spring (76) to impart a clockwise rotational force to this trip latch (80), although this rotational force is hindered by the D-shaped latch (88). On account of this, the engaged state between the abovementioned recessed portion (85) and the engaging and stopping roller (84) is maintained whereby the force due to the cross-bridging latch (86) acts on the abovementioned links (39) and (40). Accordingly, the pair of links (39) and (40) are maintained in their stretched condition against the stretching force of the counter-pressing spring (62). This, in other words, sets the standby maintaining mechanism (89) for opening the contact point to be in its on-state.

Figure 9:
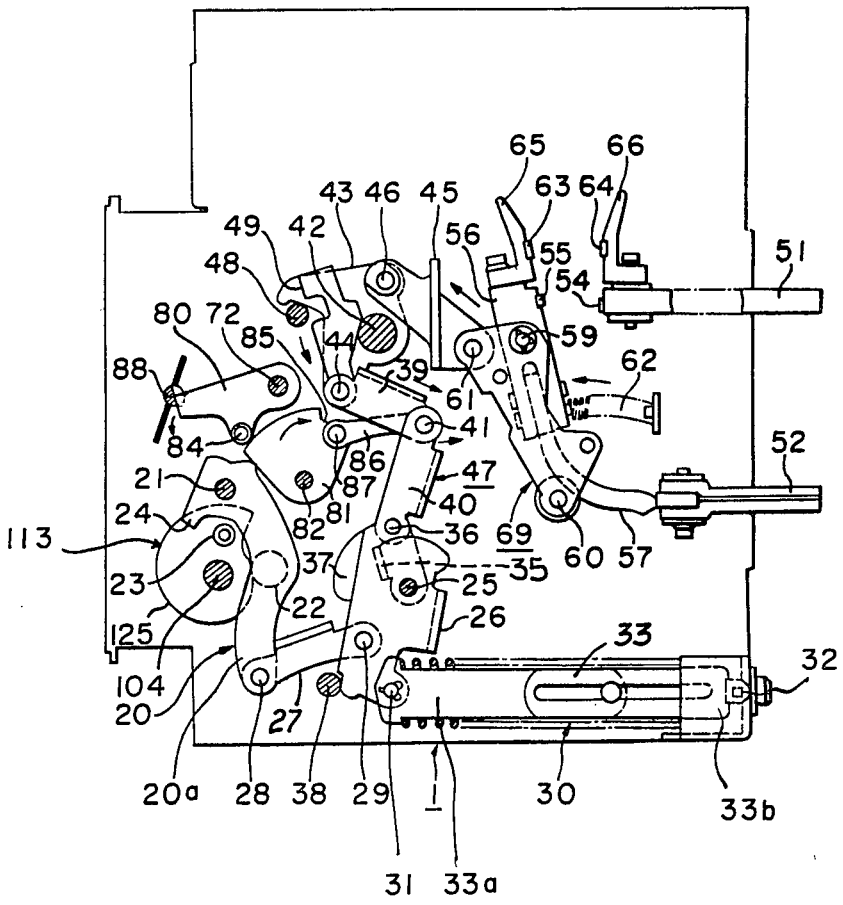
FIG. 9 is a diagram showing an operational state of the breaker at the time of the OFF-operation.

(III) At the time of OFF-operation:

At first, when the OFF-operation member (90) shown in FIG. 5 is operated against the force of the automatic return spring (91) to rotate the D-shaped latch (88) in the clockwise direction, the trip latch (80) slightly rotates clockwise against force of the return spring (76) from its state as shown in FIG. 7, whereby the engaging and stopping roller (84) of this latch (80) and the recessed part (85) of the cam plate (81) are released from their engagement. On account of this, the abovementioned cam plate (81) is rotated clockwise as shown in FIG. 9 against force of the return spring (83). As a consequence of this, the force of the cross-bridging link (86) is reduced, and the pair of links (39) and (40) are bent down in a collapsed state due to the stretching force of the abovementioned contact-pressing spring (62) transmitted to the direction changing lever (43) by means of the contact opening and closing mechanism (69), whereby the abovementioned contacts (54) and (55) are opened.

In the open state of the contact points (54) and (55), i.e., in the state as shown in FIG. 9, when the abovementioned handle operation is again performed for energy accumulation in the energy accumulating spring (30), the links (39) and (40) are stretched accordingly, while being displaced downwardly, and the cam plate (81) is rotationally displaced counterclockwise by the force of the return spring (83), hence the recessed portion (85) of the cam plate (81) becomes engaged with the engaging and stopping roller (84) of the trip latch (80) to thereby assume the state shown in FIG. 1.

While the air circuit breaker according to the present invention is practiced as mentioned in the foregoing, the gist of the invention resides in providing the circuit breaker with a rotational shaft connected to a motor, a cam rotatably supported on this rotational shaft to be rotated in one direction through a ratchet by a handle operation to thereby accumulate energy in the energy accumulating spring for a contact closure, an engaging part provided on the outer periphery of the rotational shaft, and a latch to slide on the engaging part of the rotational shaft at the time of rotation of the cam by the abovementioned handle operation, and to be engaged with the engaging part of the rotational shaft at the time of rotation of the rotational shaft in one and the same direction due to the motor to thereby cause the abovementioned cam to rotate together with the rotational shaft. Accordingly, the air circuit breaker according to the present invention has an effect of performing energy accumulation in the abovementioned energy accumulating spring both manually and electrically with a simple construction of the devive.

In the foregoing, the present invention has been described with particular reference to a preferred embodiment thereof. It should, however, be noted that the invention is not restricted to this embodiment alone, but any changes and modifications may be made by those persons skilled in the art within the ambit of the present invention as recited in the appended claims.

We claim:

1. An air circuit breaker including an energy accumulating spring for effecting contact closure and a motor, comprising:

a rotational shaft adapted to be rotated by said motor;

a ratchet operatively associated with said rotational shaft;

a cam operatively associated with said rotational shaft and integrally connected to said ratchet;

handle means operatively associated with said rotational shaft for rotating said ratchet in a first direction, said handle means including a pawl such that when said handle means is moved said pawl engages said ratchet to rotate said ratchet and said cam in said first direction;

linkage means connected between said cam and said energy accumulating spring for compressing said energy accumulating spring such that rotation of said cam in said first direction actuates said linkage means to compress said energy accumulating spring;

an engaging part formed in an outer peripheral portion of said rotational shaft; and latching means operatively associated with said cam for selectively engaging said engaging part such that when said motor rotates said rotational shaft in said first direction, said latching means engages said engaging part causing said cam to rotate in said first direction and when said handle means is moved to rotate said cam in said first direction, said latching means remains disengaged from said engaging part and said rotational shaft remains stationary.

2. The air circuit breaker as claimed in claim 1 wherein said linkage means for compressing said energy accumulating spring further comprises a charge lever operatively associated with said cam, a link operatively associated with said charge lever and a closed arm operatively associated with said link and said energy accumulating spring such that rotation of said cam in said first direction causes said charge lever, said link and said closed arm to move so as to compress said energy accumulating spring.

3. The air circuit breaker as claimed in claim 1 further comprising a spring holder which is expansible and contractible and wherein said energy accumulating spring is mounted on said spring holder.

4. The air circuit breaker as claimed in claim 1 wherein said engaging part further comprises a notch formed in an outer peripheral portion of said rotational shaft and wherein said latching means includes a spring for urging said latching means against said rotational shaft.

5. The air circuit breaker as claimed in claim 1 further comprising a connecting pin rotatably supporting said latching means in a gap between said ratchet and said cam.

6. The air circuit breaker according to claim 1 further comprising a gear box adapted to connect said motor to said rotational shaft.

7. The air circuit breaker according to claim 1 wherein said handle means operatively associated with said rotational shaft, said ratchet operatively associated with said rotational shaft and said cam operatively associated with said rotational shaft further comprise said handle means, said ratchet and said cam rotatably supported on said rotational shaft such that when said handle means is moved, said handle means, said ratchet and said cam rotate about said rotational shaft and said rotational shaft remains stationary, and when said motor rotates said rotational shaft said handle means remains stationary.

* * * * *